US006749190B2

(12) United States Patent
Studer

(10) Patent No.: US 6,749,190 B2
(45) Date of Patent: Jun. 15, 2004

(54) METHOD AND DEVICE FOR THE GATHERING OF FLAT ARTICLES

(75) Inventor: Beat Studer, Dürnten (CH)

(73) Assignee: Ferag AG, Hinwil (CH)

( * ) Notice: Subject to any disclaimer, the term of this patent is extended or adjusted under 35 U.S.C. 154(b) by 139 days.

(21) Appl. No.: 10/024,868

(22) Filed: Dec. 19, 2001

(65) Prior Publication Data

US 2002/0079191 A1 Jun. 27, 2002

(30) Foreign Application Priority Data

Dec. 27, 2000 (CH) ..... 2525/00

(51) Int. Cl.[7] ..... B65H 39/06

(52) U.S. Cl. ..... 270/52.14; 270/52.19; 271/69; 271/205

(58) Field of Search ..... 270/52.14, 52.19, 270/52.01; 271/69, 204, 205, 206, 314, 315, 82, 83; 198/647

(56) References Cited

U.S. PATENT DOCUMENTS

| | | | | | |
|---|---|---|---|---|---|
| 4,058,202 | A | * | 11/1977 | Reist et al. | 198/470.1 |
| 4,471,953 | A | * | 9/1984 | Reist et al. | 270/58.01 |
| 4,489,930 | A | * | 12/1984 | Meier | 270/52.3 |
| 4,706,951 | A | * | 11/1987 | Leu | 270/52.22 |
| 5,007,624 | A | * | 4/1991 | Chandhoke | 270/58.2 |
| 5,094,438 | A | * | 3/1992 | Reist et al. | 270/52.3 |
| 5,104,108 | A | * | 4/1992 | Honegger | 270/52.3 |
| 5,660,382 | A | * | 8/1997 | Meier | 270/52.16 |
| 5,727,783 | A | * | 3/1998 | Tassinari | 271/185 |
| 5,758,871 | A | * | 6/1998 | Schlough | 270/52.27 |
| 5,992,840 | A | * | 11/1999 | Meier | 270/58.29 |
| 6,254,088 | B1 | * | 7/2001 | Kramer et al. | 271/204 |

FOREIGN PATENT DOCUMENTS

| | | |
|---|---|---|
| CH | 668 245 A5 | 12/1988 |
| EP | 0 806 392 A2 | 11/1997 |
| EP | 0 857 681 A1 | 8/1998 |
| EP | 0 870 710 A1 | 10/1998 |

* cited by examiner

*Primary Examiner*—Patrick Mackey
(74) *Attorney, Agent, or Firm*—Rankin, Hill, Porter & Clark LLP

(57) ABSTRACT

An apparatus and method are provided for gathering flat articles (5) into stacks (9) by conveying stacks in production successively along a gathering route (1) past feed stations. The stacks (9) are conveyed on stack supports (2) with supporting surfaces (7). Leading edges (5.1) of the articles (5) to be added to the stacks are held by holding elements (4) that move in a supply route (3) that traverses the gathering route (1) at the feed stations. Each article (5) is inserted between successive stacks (9) or stack supports (2), with the leading edge (5.1) being inserted first. The inserted article is released from its associated holding element (4) and then positioned on the upstream or downstream stack (9) or stack support (2) by the force of gravity and/or by its own inertia, and the holding element (4) is conveyed onwards in a downward direction.

20 Claims, 7 Drawing Sheets

METHOD AND DEVICE FOR THE GATHERING OF FLAT ARTICLES

BACKGROUND OF THE INVENTION

The present invention generally relates to the field of conveying and further processing of flat articles and, more particularly, to the conveying and further processing of printed products. The present invention also concerns a method and a device for gathering flat articles and collating printed products.

In the printing field, a method for gathering or collating comprises forming stacks, each comprising a plurality of printed products. The printed products contained in each stack generally differ from one another, and usually all of the gathered stacks essentially contain the same printed products in substantially the same sequence. In dispatch station technique, for example, a multitude of finished printed products are gathered respectively into dispatch units which can then be welded into a foil. Additionally, in dispatch station technique different supplements are gathered and then inserted as an enclosure into a main product such as a newspaper. Both of the finished printed products noted above, as well as the supplements, may have very different formats and different thicknesses. Furthermore, it is becoming more common to process other flat articles, such as CDs or different varieties of sample packages, with the printed products. In the field of book printing, for each book to be bound, a plurality of signatures is gathered. Each signature comprises a plurality of the book's pages, and all signatures usually have the same format. In the same manner, "stacks" can be produced that only comprise a single flat article.

According to the prior art, printed products are gathered or collated by conveying stacks being produced behind each other along a collating route past a plurality of feed stations, and by adding one printed product to each stack at every feed station. The stacks are conveyed along the collating route parallel to their flat expanse and lying in a horizontal or inclined position on a stack support, which is either conveyed along with the stack or else is stationary and extends in the conveying direction. The printed products to be added to the stacks being conveyed past the respective feed station are, in most cases, supplied and deposited on the stack in a direction perpendicular to the stack conveying direction. Instead of conveying the stacks parallel to the flat expanse of the printed products, it is also known to convey the stacks with each one lying on an inclined stack support that extends transversely to the direction of stack conveyance and, while being supported in the downward direction, the stack supports are conveyed along together with the stacks in production. The printed products to be added to these stacks are usually supplied in the stack conveying direction.

Stacks being conveyed parallel to the flat expanse of the stacked printed products or the stack support surfaces (parallel conveyance) are conveyed along the collating route substantially one behind the other and the distance between stacks along the collating route is essentially determined by the largest product formats to be processed. In the case of stack conveyance that is not parallel, but instead is substantially transverse to the flat expanse of the printed products or stack support surfaces (transverse conveyance), the stacks are arranged along the collating route substantially lying one behind the other, so that the distance from stack to stack in essence is determined by the greatest stack height or stack thickness to be anticipated. Because the stacks usually have a relatively small height or thickness in comparison with their width and length (flat expanse of the stacked products), this means that for an equivalent conveying capacity, parallel conveyance calls for a much higher speed than transverse conveyance.

The length of a collating route in each case is determined by the number of feed stations to be provided and by how much space each feed station requires along the collating route. Using parallel conveyance, it is possible with relatively simple layouts to arrange the feed stations such that the distance between two neighbouring feed stations is not much larger than the actual stack expanse in the conveying direction. Accordingly, in each conveying cycle a product can be added to the stack. In transverse stack conveyance, if this was also possible, collating routes could be significantly shorter than collating routes with parallel conveyance. Unfortunately, however, this is not possible according to the prior art. Therefore, very compact collating layouts comprise combinations of parallel and transverse conveying systems. Examples of such combinations are drum-shaped arrangements, in which stacks in production are conveyed transversely around the circumference of the drum, while parallel conveyance is simultaneously employed in an axial direction, which results in a spiral-shaped collating route. The same is achieved in linear layouts, in which the stacks in production are conveyed transversely together with V-shaped compartments and simultaneously are displaced in a parallel manner within the compartments, resulting in a route with a diagonal course.

One of the reasons that feed stations to collating routes with transverse conveyance require a relatively large space is that every printed product to be supplied must first be inserted between two successive stacks or stack supports before it can be positioned on one of the stacks. The smaller the distance between stack supports, the higher the accuracy must be in the insertion step. Usually the products are supplied from above, held at upper edges in a hanging position. They are then inserted between the stack supports while still hanging, and are then released while the held upper edges are still positioned above the stack support. This means that during insertion the leading edge is substantially unguided. For a product with a relatively small length from leading to trailing edge when compared to the height of the stack, the free fall after release is relatively long. This means that insertion is to be carried out relatively slowly and, therefore, requires several conveying cycles. Accordingly, feed stations along the collating route need to have a corresponding length. Thus, a system of this kind imposes tight limits on the variations in format of the printed products to be fed, and the absolute conveying speeds have an upper limit, particularly when the products to be fed are not very stable and may already be deformed by a low relative wind speed.

A collating system with a multitude of V-shaped compartments that a printed product is inserted into at every feed station from a hanging position and laid against the trailing wall of the compartment, is described in the publication CH-668245. The feed stations in this system are arranged one behind the other, with a distance between one another that is almost twenty times greater than the extent of the compartments in the conveying direction (i.e., there are approximately twenty conveying cycles between two successive feed stations.). In the publication EP-0857681, it is proposed to insert hanging products between L-shaped stack supports from one side and above, and to release them when their upper edge is laterally aligned with the stack support and is still positioned above it. In this manner, it is possible to arrange the feed stations along the collating route overlapping one another so that the distance between feed stations may be reduced, depending on the arrangement, resulting in very few conveying cycles. However, in this system the leading edges of the products are unguided during insertion so that the limitations regarding insertion speed and absolute conveying speed are the same as in the case of the insertion from above without a lateral component.

SUMMARY OF THE INVENTION

It is an object of the present invention to create a method and a device for gathering or collating flat articles that makes it possible not only to combine transverse conveyance along the gathering route with small distances between feed stations in conveying cycles, but also significantly expand the limits applicable up until now with respect to the processing of articles having different formats and with respect to conveying speed, even when processing not very stable articles. Accordingly, an object of the present invention is a method and device for gathering or collating in more compact layouts with higher piece per time unit capacities than was possible for gathering or collating according to prior art.

In accordance with the present invention, flat articles are added to the stacks between the stack supports while being held at their leading edges, and are released only when the inserted article is substantially aligned to the stack position with only a very small, unguided movement required for positioning the article on the stack or laying it against the stack support. Immediately preceding insertion and during insertion, the articles are moved in a direction comprising a component that is parallel to the direction of stack conveyance. The articles may be inserted into V-shaped compartments as mentioned above, with the lower edge of each article to be inserted being held by a holding element and the holding element, and is only deactivated when the held edge has essentially reached the floor of the compartment. The floor supports the released article for further conveyance. It is possible to feed the articles from the side or from below in substantially the same manner.

Held guidance of the leading edges during insertion between successive stacks produces significantly higher insertion accuracy than held guidance of the trailing edges. Therefore, insertion is rendered less dependent on the stability of the articles and insertion speed. The higher insertion accuracy also makes it possible to have the stack support surfaces follow one another more closely, which once again either enables the stack conveying speed to be reduced, or using the same stack conveying speed, the piece per time unit capacity to be increased. A further advantage resulting from held guidance of the leading edges between stack supports and from the insertion accuracy associated with it is that it becomes possible to add articles with different formats and thicknesses to the stacks without risking conflicts between them during insertion or during positioning on the stacks.

With regard to the device for inserting articles according invention, articles are held by their leading edge between stack supports. A stack conveying means with stack supports being conveyed behind each other and feed means with holding elements being conveyed one behind the other, are arranged such that the conveying path of the holding elements traverses the conveying path of the stack supports. This means that the two conveying operations are to be matched to one another such that in traversing, one holding element is moved between each two successive stack supports. Furthermore, control means are to be provided for deactivating the holding elements during the traversing, advantageously right at the end of traversing.

The conveying system with traversing conveying paths is implemented in such a known manner in that the stack supports are arranged on a first conveying organ (e.g., traction chain), the holding elements on a second one, the two conveying organs being independent of one another and arranged in planes parallel to one another. Stack supports and holding elements are arranged facing towards each other on the corresponding conveying organ in such a manner that at the crossing they pass through one another in a combing manner. It is also possible to provide more than two conveying organs in such a manner that the holding elements pass between two stack support parts at a distance from each other, or two holding element parts are conveyed on either side of the stack supports.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
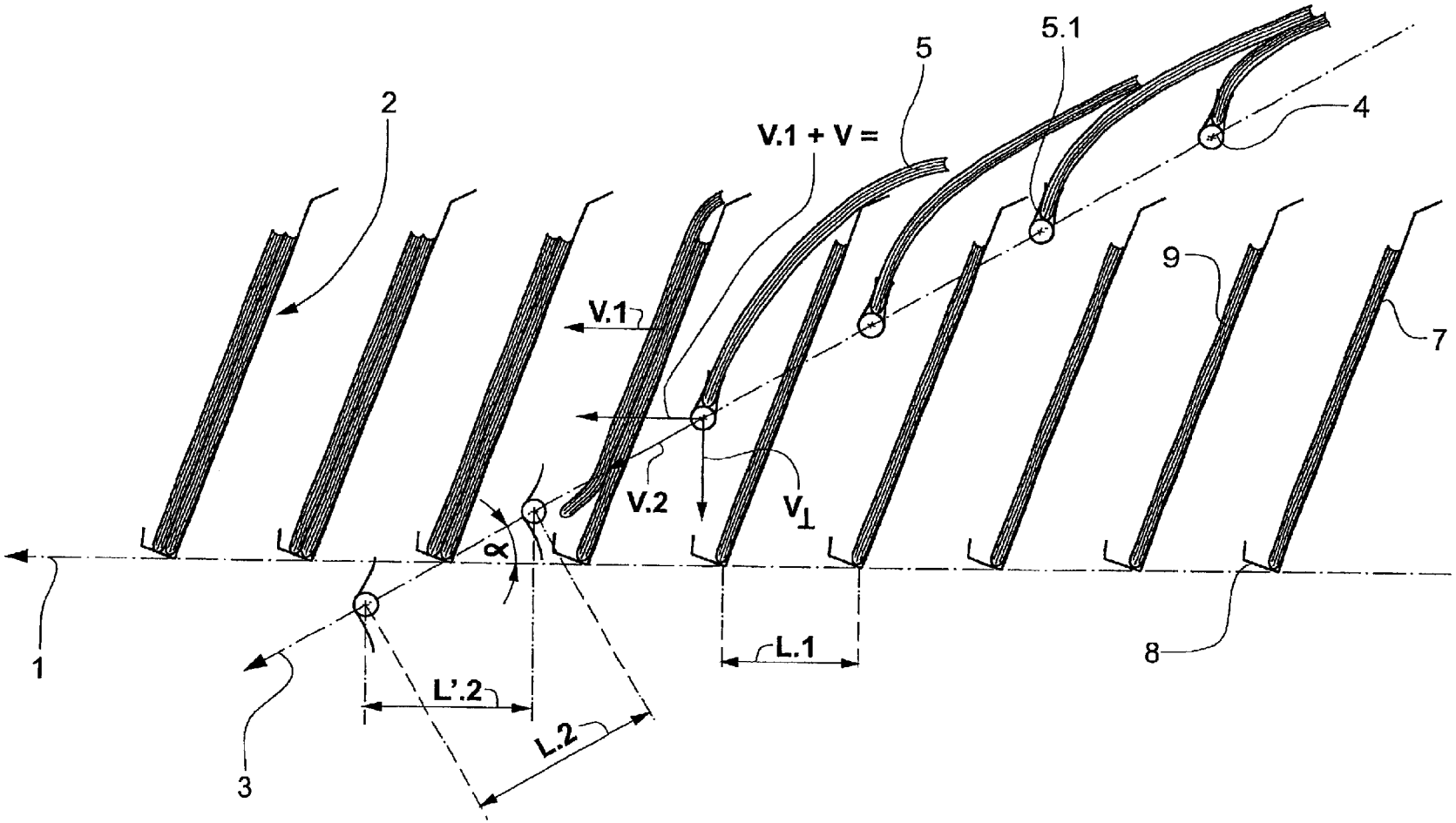
FIGS. 1 and 2 show the principle of the method according to the invention, illustrated by a process of inserting products between L-shaped stack supports and positioning them on the upstream stack support (FIG. 1) or on the downstream stack support (FIG. 2), viewed transverse to gathering route and feed direction.
Figure 2:
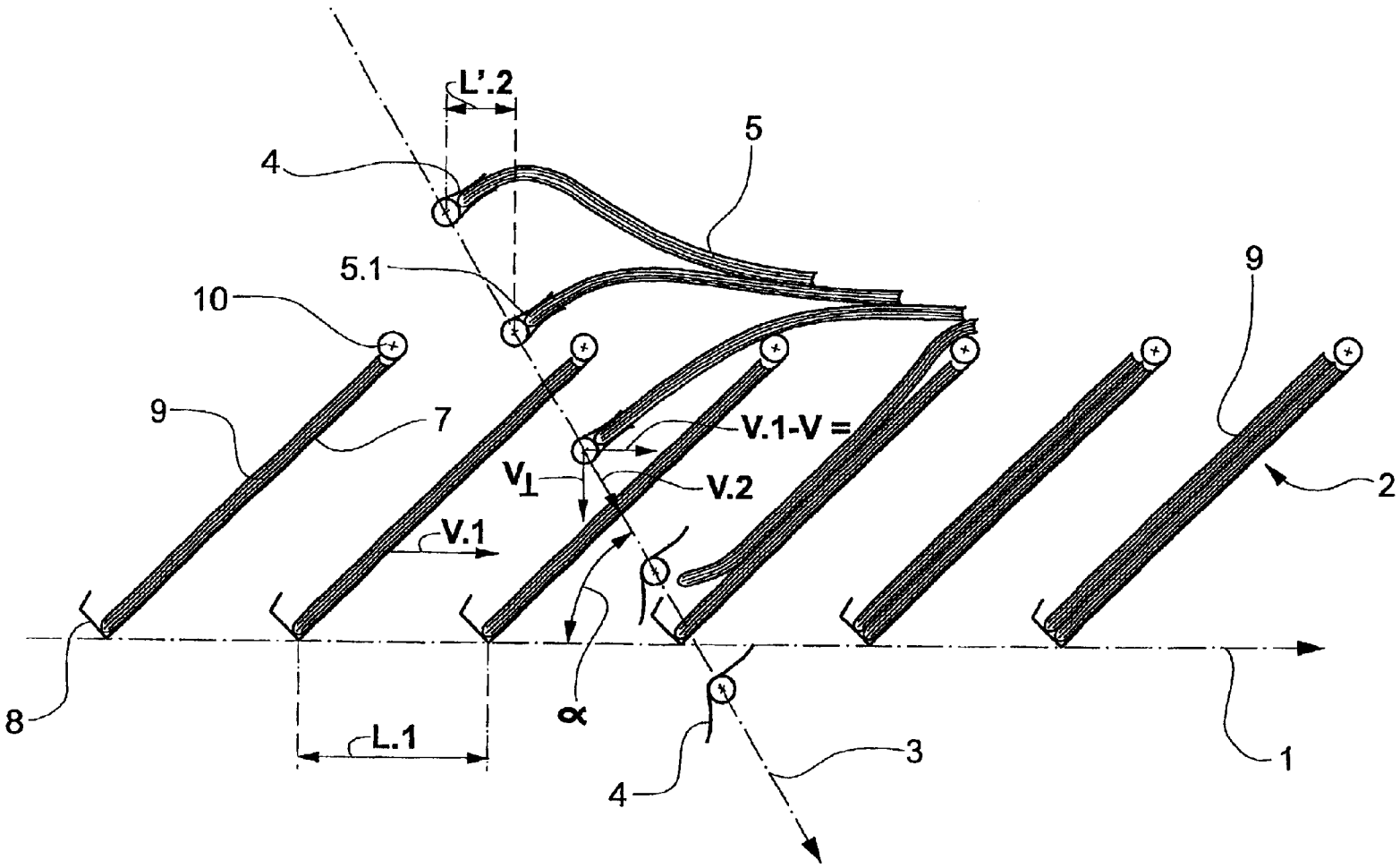

FIGS. 1 and 2 illustrate the method according to the invention and depict a part of two exemplary embodiments of the arrangement for gathering in accordance with the invention. Schematically depicted are a gathering route 1 with stack supports 2, conveyed one after the other in the stack conveyance direction, extending transversely to the gathering route 1 and slanting in the stack conveyance direction, and a supply route 3 with holding elements 4. The holding elements are grippers that are closed to pick up an article 5, and opened to release the gripped article 5, by corresponding control means (e.g., cams; not illustrated). The arrangement is viewed both transversely to the conveying directions and parallel to the stack supports 2, so that of the stack supports and of the articles 5 to be gathered only the edges or narrow sides respectively are visible.

The gathering route 1 and the supply route 3 intersect in the zone of the feed station at an angle $\alpha$ smaller than 90°, i.e., the supply direction has a component parallel to the stack conveyance direction.

The L-shaped stack supports comprise a supporting surface 7 and a stop ledge 8 which, in both illustrated cases, is located at the bottom of the supporting surfaces 7. The stop ledge 8 supports from below articles or stacks 9 lying against the supporting surfaces 7. The supporting surfaces 7 extend transversely to the conveying direction and form an advantageously acute angle with vertical. The supporting surfaces 7 can also be arranged to be flatter, or in the extreme case horizontal, and therefore parallel to the stack conveyance direction.

The supplied articles 5 are represented as relatively flexible printed products, which are held at a fold edge (gripped edge 5.1). However, this is not a condition for the invention. The articles 5 can also be rigid and/or can be held at any specific edge.

In accordance with FIG. 1, the stack supports are arranged such that their upper edges are positioned further upstream than the lower edges. The supplied articles 5 are held by holding elements 4 such that the gripped fold edges 5.1 are facing forward. This means that each one of the articles 5 is pulled over the upper edge of a supporting surface 7 when being inserted between the stack supports 2. These upper edges may be slightly bent backwards or rounded in order to assure that the articles slide down without complications. For releasing the articles 5, the holding elements 4 are opened immediately ahead of the height of the stop ledge 8. When an object is released in this way and is not driven after release, the supporting surface 7, and if applicable, the articles already stacked on it (stack 9), catch up with the object because of its inertia. In this manner it is laid against the supporting surface or against the stack and is driven towards the stop ledge 8 by the force of gravity.

As shown by FIG. 1, the position of the holding element 4 is located approximately at the midpoint between the two stack supports during the four conveying cycles needed for traversing the stack supports 2. This means that a stack 9 already present is not allowed to be thicker than half the distance between the stack supports 2. If this condition is fulfilled, then the leading guided edge 5.1 cannot come into conflict with any previously stacked article, even if these extend very little in the direction of the height of the stack supports 2.

The speed v.1 of the stack supports 2 being given, the holding elements as illustrated in FIG. 1 need to have a speed v.2, with a component in the direction of the gathering route 1 being greater than v.1 by a relative speed v=and a component v⊥ perpendicular to the gathering route 1 and corresponding to the desired insertion speed. The angle α and the distances L.2 (or their projection L'.2 onto the gathering route 1) between the holding elements 4 result from the ratio of v.1+v= and v⊥ and from the distances L.1 between the stack supports, wherein in the illustrated case v= is determined by the inclination of the supporting surfaces 7. The higher the insertion speed v⊥ is to be and the steeper the stack supports 2 are, the greater α becomes. In the case presented here, L'.2 and also L.2 are greater than L.1.

FIG. 2 illustrates a process of inserting articles 5 between consecutive stack supports 2 and positioning them on the supporting surface 7 of the downstream stack support 2. The supporting surfaces 7 have leading upper edges. Before they can be supplied, the objects 5 are aligned such that the gripped leading edges are facing upstream. The downstream facing unguided parts of the supplied articles and the unguided edge 5.2 first meet with the upper edges of downstream stack supports 2 and during insertion are drawn over these. In order to prevent problems when the articles are drawn over them, the upper stack support edges may be equipped with corresponding freely rotating rollers 10. The supplied articles 5 are drawn downwards over the supporting surfaces 7 or over articles (stack 9) already stacked on these, wherein the holding elements 4 at the beginning of the insertion are positioned closer to the supporting surface 2 downstream and at the end of the insertion closer to the supporting surface upstream. Because of this, the inserted article 5 is positioned on the supporting surface 7 or on articles already stacked on it (stack 9), and is conveyed along with it before it is released from the holding element 4. After being released, it slides down onto the stop ledge 8 under the force of gravity. The supporting surfaces 7 are advantageously arranged in a manner that is less steep than the case illustrated in FIG. 1. In this case, the effect achieved by the inertia of the released articles in the embodiment according to FIG. 1 is taken over at least partially by the force of gravity.

The speed v.2 of the holding elements 4 for the embodiment illustrated in FIG. 2 comprises a component parallel to the gathering route 1, which is smaller than v.1 by a relative speed v=. L'.2, and is therefore smaller than L. 1.

As mentioned above, the stop ledges 8 on the stack supports 2 illustrated in FIGS. 1 and 2 are located at the bottom, and the articles 5 are inserted from above between the stack supports 2, wherein for the final positioning of the articles 5 on the supporting surfaces 7 or on articles already stacked on them, the force of gravity can be exploited. This, however, is not a condition for the method and the device according to the invention. FIGS. 1 and 2 can be quite readily understood as views from above instead of as side views, this in the meaning of a supply to a gathering route 1 from the side. In such a case, the stop ledge 8 as depicted solely serves to stop the released articles 5 and these are driven by the force of gravity against a not depicted edge of the supporting surface 7 inclined along the stack conveyance direction. An arrangement in accordance with FIG. 1, also in which the inertia of the released objects is exploited for their positioning, in such a case will be more advantageous than an embodiment according to FIG. 2, in which this inertia is not exploited.

Figure 3:
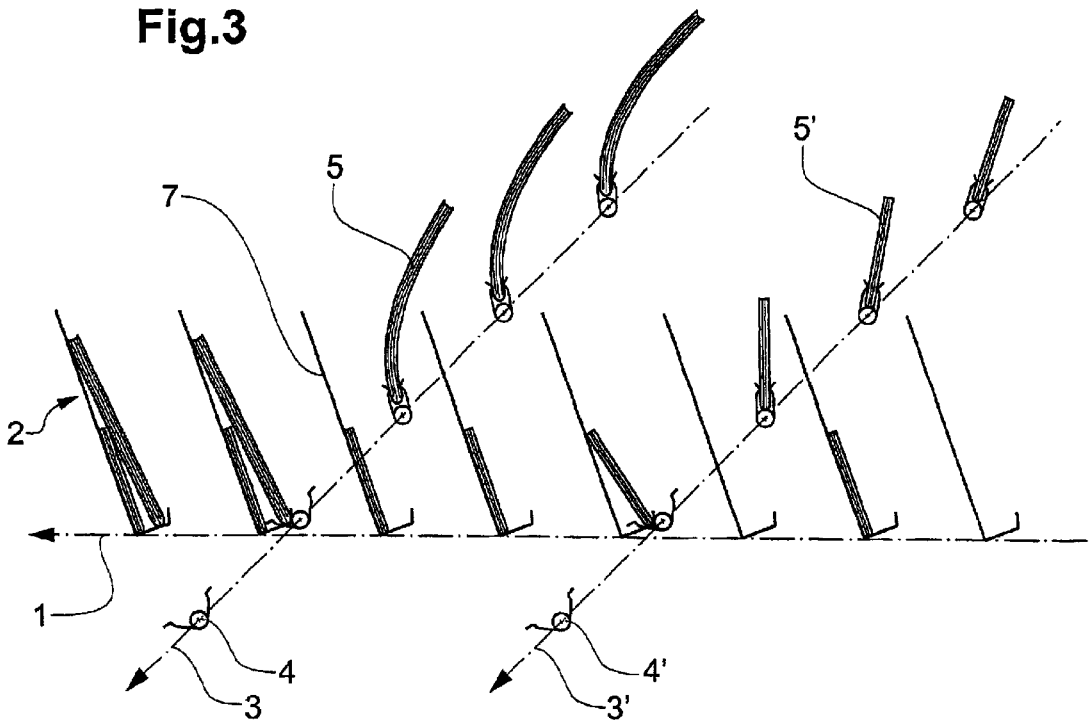
FIG. 3 shows a section of an exemplary gathering route with two consecutive feed stations.

FIG. 3 shows in the same way as FIGS. 1 and 2 a further embodiment of the method according to the invention. The articles 5 are supplied with the gripped edges directed forwards (as in FIG. 1) and are then laid against the downstream supporting surface 7. To do this, it may be advantageous to make use of holding elements 4 (or 4'), which are capable of being swivelled relative to the supply route 3 or 3', so that the articles prior to being released can be swivelled against the leading supporting surface 7. This is particularly applicable in particular for rigid articles 5' being supplied to the first feed station, as shown in FIG. 3 (feed route 3', holding element 4').

FIG. 3 also makes it clear how close together the feed stations can be positioned along a gathering route 1 according to the invention. In the illustrated case, the distance between the feed stations amounts to only three conveying cycles.

Figure 4:
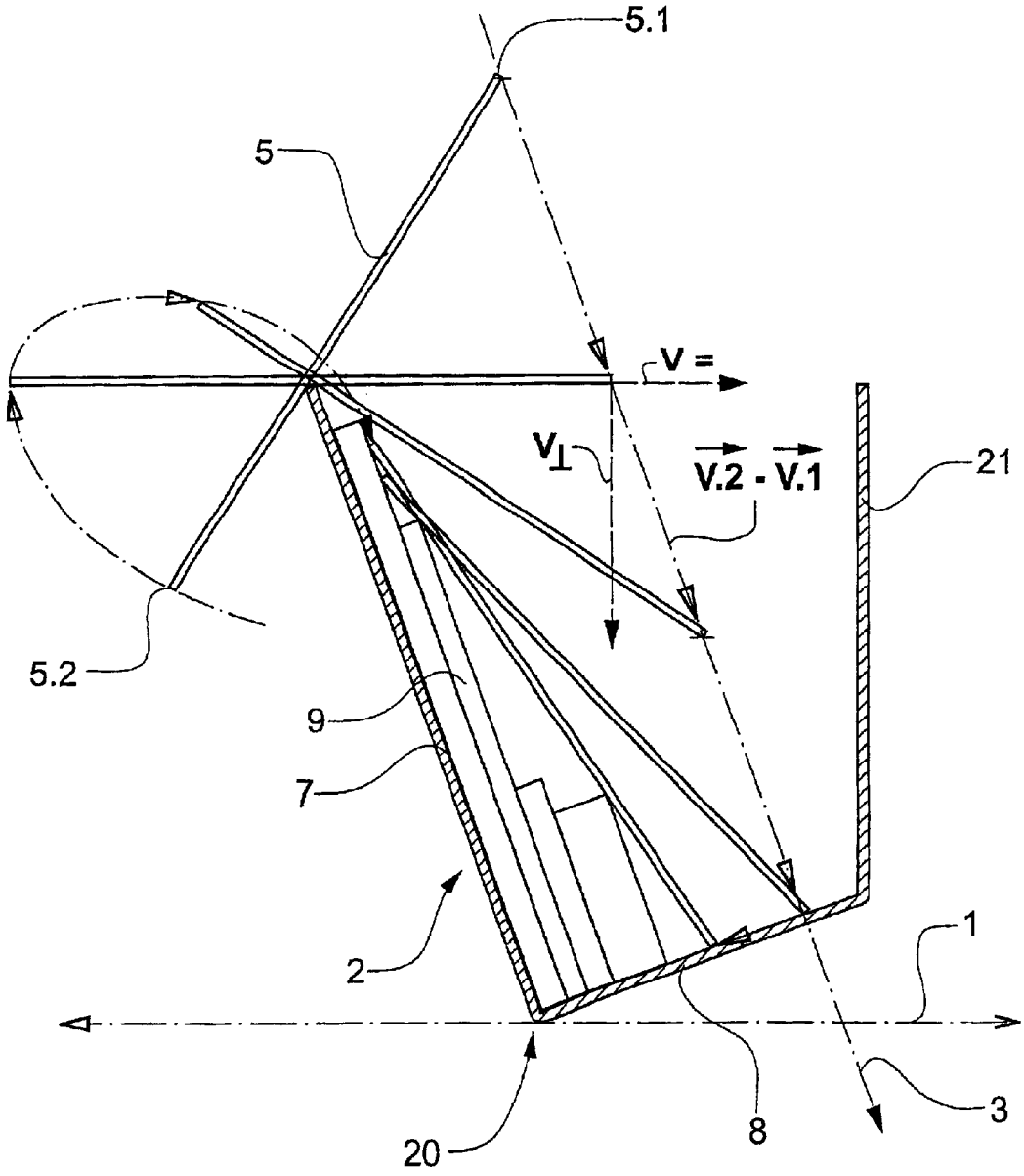
FIGS. 4, 5, and 6 show insertion between stack supports and positioning on the stacks in detail for exemplary collating in V-shaped compartments (FIGS. 4 and 5) and on L-shaped stack supports (FIG. 6)
Figure 5:
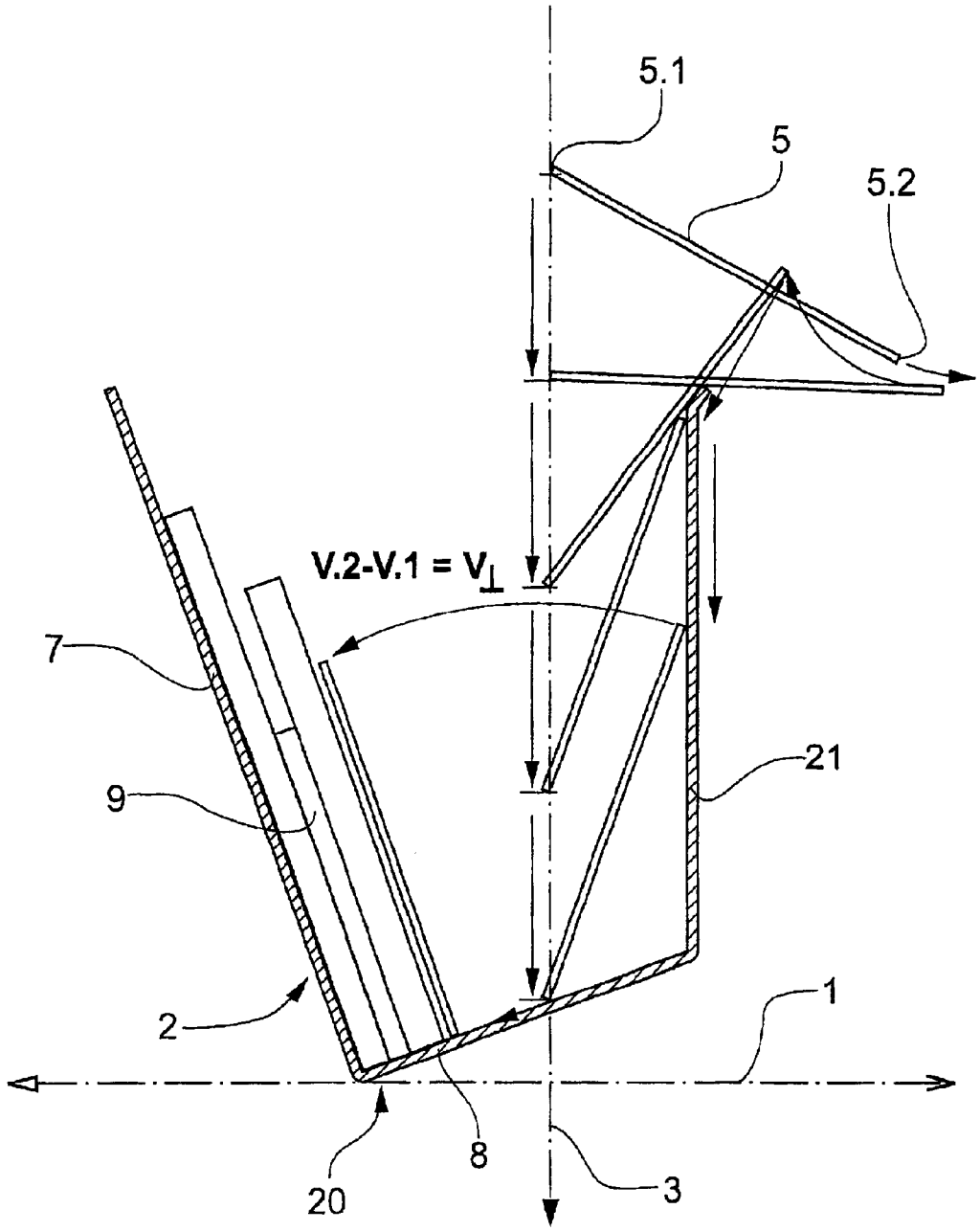
Figure 6:
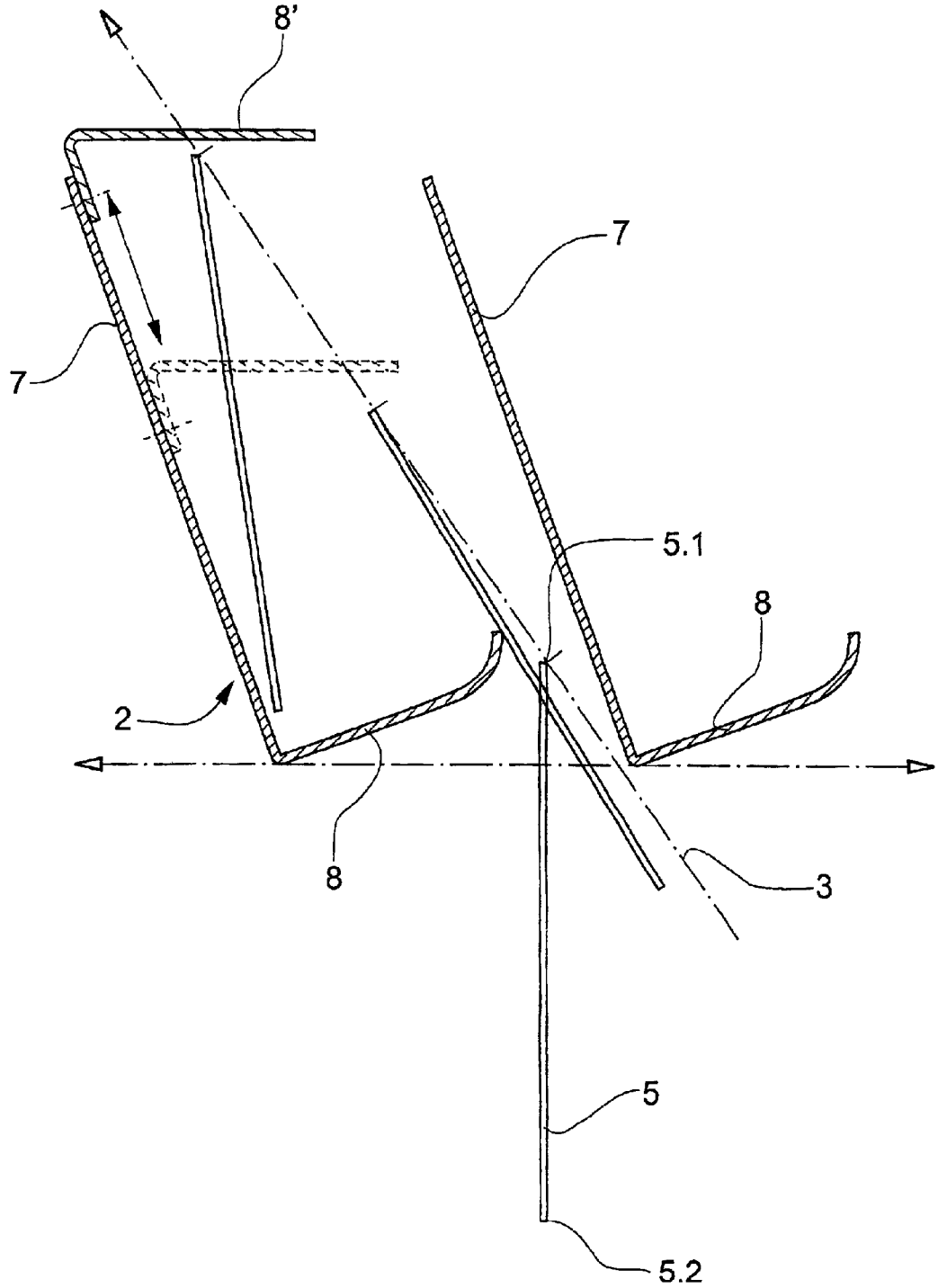

FIGS. 4, 5, and 6 depict supplied articles 5 during successive phases of their insertion between the stack supports 2. In FIGS. 4 and 5, the functions of the supporting surface 7, the stop ledge 8, and an adjacent stack support are taken over by the corresponding parts of a V-shaped compartment 20, into which a flat article 5 is inserted from above. In FIG. 6, the stack support 2 is L-shaped and the article 5 is inserted from below. The illustrated insertions are viewed from a point conveyed along with the stack support 2 (direction of view transverse to the gathering route). Therefore, in order to see the absolute movements, stack conveyance (in all Figs. having a horizontal direction) is to be superimposed on the illustrated movements. The depicted movement of each holding element and gripped edge 5.1 along the supply route 3 has a relative speed v.2−v.1 (vector difference) with the components v= (relative speed) and v⊥ (insertion speed).

In FIGS. 4, 5, and 6, the article to be inserted 5 is depicted as being rigid. Thus, it is necessary that the holding elements (not shown) are designed for at least passive swivelling relative to the supply route 3 during the insertion. Bendable articles do not require swivellable holding means. Insertion, however, takes place in an analogous manner to insertion when the articles are bent.

FIG. 4 illustrates insertion from above into a V-shaped compartment 20. Of this compartment, one side wall takes over the function of the supporting surface 7 and the floor assumes the function of the stop ledge 8. The second side wall 21 of this embodiment has no function. The gripped edge 5.1, which during supply is directed away from the supporting surface 7, is guided against the stop ledge 8 in a direction substantially parallel to the supporting surface 7 and shortly before the ledge, it is released. During insertion, the article 5 or its edge 5.2 opposite the gripped edge 5.1, respectively, is drawn over the top edge of the stack supporting surface 7 and then slides downwards along the stack supporting surface 7 or along a stack 9 lying on it, as is already illustrated in FIGS. 1 and 2. When the gripped edge 5.1 is released, it is driven against the stop ledge 8 by the force of gravity. If stack conveyance is directed from left to right (positioning on the upstream stack support), then the article 5 is driven against the supporting surface 7 by the force of gravity and by its inertia. If stack conveyance is directed from right to left, then the inertia of the article 5 acts in a direction away from the supporting surface 7. In such a case it might be necessary to provide further means, for example, a slider acting from the opposite wall 21, for the final positioning of the article 5 on the stack 9 in addition to the force of gravity. The direction of stack conveyance along the gathering route 1, however, does not play an essential role for insertion.

FIG. 5 illustrates in the same manner as FIG. 4 insertion into a V-shaped compartment 20 wherein, during insertion, the article 5 is drawn over the opposite wall 21 of the compartment 20. The movement of the gripped edge 5.1 is in this case perpendicular to the gathering route 1, and the relative speed v= of the holding element relative to the stack support is therefore equal to zero (L'.1=L.1). From FIG. 5 it is clearly evident that for the final positioning of the inserted article 5 at least the inertia (stack conveyance from left to right) has to be effective or else further means, as already mentioned, must be used.

FIG. 6 shows in the same way as FIGS. 4 and 5 a further way for inserting articles 5 between successive stack supports 2. The articles 5 are supplied from below and are substantially suspended. They are guided over the outside edge of the stop ledge 8 and, by the force of gravity, positioned standing upright on the stop ledge 8, leaning against the supporting surface 7. The stop ledge 8, therefore, in this embodiment does not have an actual stop function, but only a stack supporting function. For the stop function a second stop ledge 8' can be provided in the upper zone of the stack support 2. It is obvious that in this case the direction of the stack conveyance along the gathering route 1 plays a very subordinate role.

A disadvantage of the insertion illustrated in FIG. 6 is shown by the fact that the gripped edge 5.1 (top edge) is to be positioned opposite the stop ledge 8. Therefore, the movement necessary for the final positioning of the article 5 (free fall) is longer for articles having a shorter distance between the edges 5.1 and 5.2 than for articles with a correspondingly longer distance if the release position of the gripped edge 5.1 is not changed. This disadvantage, however, can easily be remedied in that the position of the holding element in which it is deactivated and the position of the second stop ledge 8' (dot-dash position of 8') are adapted to the distance.

FIGS. 1 to 6 illustrate exemplary methods for inserting articles between stack supports conveyed along a gathering route, wherein from the illustrated methods further methods can be easily derived. Successful application of one method or the other is dependent on the manner in which the articles to be supplied are advantageously taken over and on the orientation in which they need to be stacked.

In all FIGS. 1 to 6, both the gathering route 1 as well as the supply route 3 are depicted as straight lines, which in the case of constant conveying speeds v.1 and v.2 results in a straight-line insertion with a constant speed. This is in no way a condition for the method in accordance with the invention. In particular, for generating an insertion speed v⊥ diminishing towards the end of the insertion, the supply route 3 can be designed as correspondingly curving towards the direction of the gathering route 1.

Figure 7:
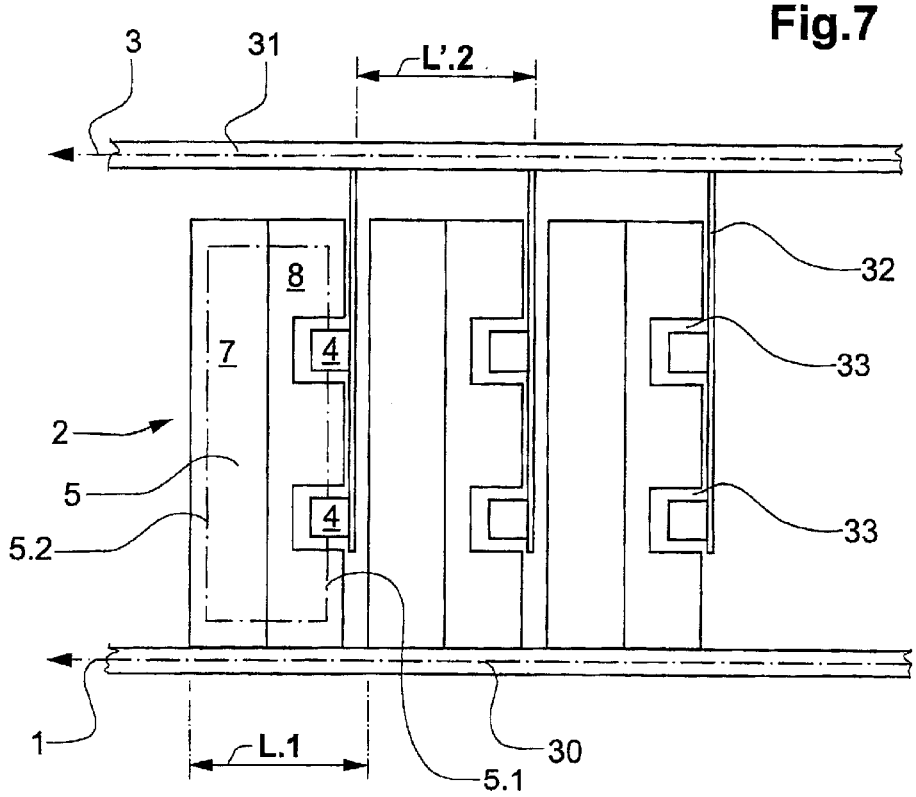
FIGS. 7, 8, and 9 show three different, exemplary embodiments of the traversing conveying means with stack supports and holding elements (viewed parallel to the conveying planes).
Figure 8:
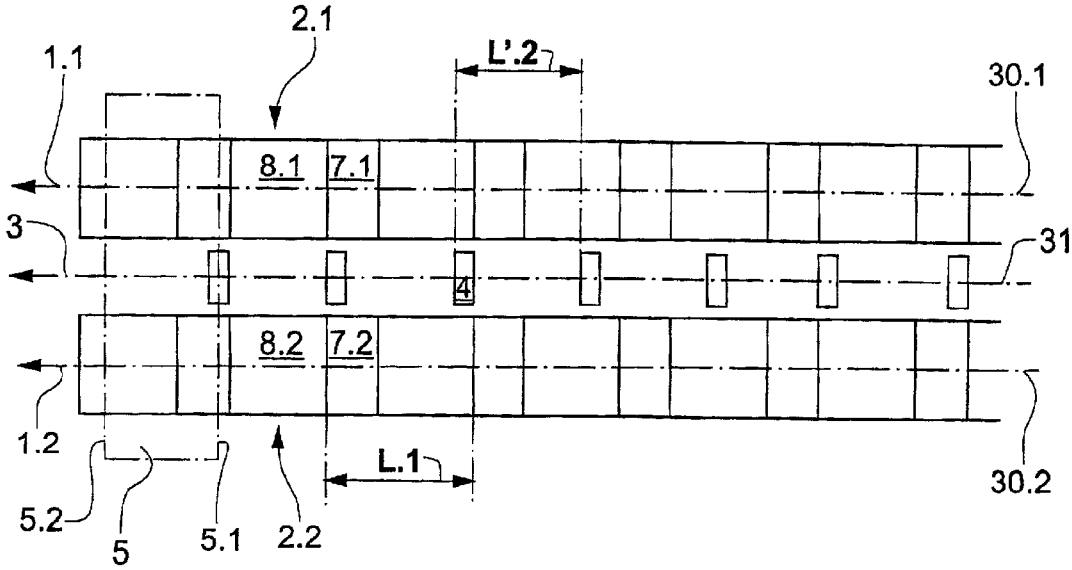
Figure 9:
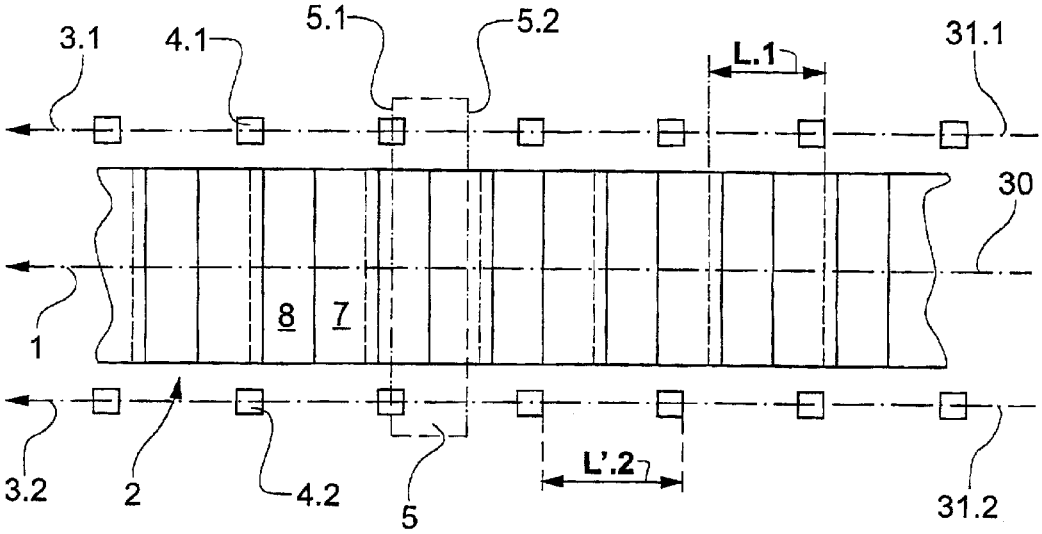

FIGS. 7, 8 and 9 illustrate three exemplary embodiments of the arrangement according to the invention, viewed in a direction generally vertical to the viewing direction of FIGS. 1, to 3, or in the case of a supply from below or from above, equivalent to a bird's eye view. Schematically depicted are a plurality of stack supports 2 (or 2.1 and 2.2) being conveyed along a gathering route 1 (or 1.1 and 1.2) and a plurality of holding elements 4 (or 4.1 and 4.2) being conveyed along a supply route 3 (or 3.1 and 3.2). The stack supports 2 and the holding elements 4 are each arranged on at least one separate conveying organ 30 (or 30.1 and 30.2) and 31 (or 31.1 and 31.2). The conveying organs, for example, are traction chains.

FIG. 7 illustrates stack supports 2 each with a supporting surface 7 and a stop ledge 8 as well as pairs of holding elements 4 arranged on bars 32. The stack supports 2 are arranged on a first lateral conveying organ 30. The bars 32 are arranged on a second conveying organ 31. The second conveying organ 31 is arranged laterally opposite to the first conveying organ 30. The stop ledges 8 have passages 33 for the holding elements 4. The conveying organs 30 and 31 are driven synchronously in such a manner that the holding elements 4 while traversing the gathering route 1 pass in a combing manner between stack supports 2 and through passages 33, and therewith out of the traversing zone. Immediately prior to passing through the passages 33, the holding elements 4 are deactivated and an article 5 gripped at its edge 5.1 is leaned against the supporting surface 7 and is conveyed onwards standing on the stop ledge 8.

For the layout in accordance with FIG. 7, the distances L.1 and L'.2 between stack supports 2 and holding elements 4 in the direction of the gathering route 1 are equal. This signifies that the position of the holding elements relative to the stack supports 2 remains unchanged in the direction of the gathering route 1 during insertion, as has already been described in connection with the FIG. 5. The arrangement, however, can also be implemented with different distances L.1 and L'.2.

FIGS. 8 and 9 illustrate in the same manner as in FIG. 7 two further embodiments of the arrangement according to the invention. The stack supports and the holding elements in these cases are not designed to be passing through one another in the manner of a comb for the traversing of the two conveying tracks, but move separately from one another in parallel conveying planes, which are vertical to the paper plane.

FIG. 8 depicts an arrangement in which the stack supports each comprise two stack support parts 2.1 and 2.2, which at a distance between one another are conveyed synchronously along the gathering route, each respectively by a first conveying organ 30.1 and 30.2. The holding elements 4, which are arranged on a second conveying organ 31, move between the stack support parts 2.1 and 2.2. The distances L.1 are greater than the distances L'.2, that is, the holding elements 4 move between the stack supports against the stack support further upstream, as has also been described in connection with FIG. 2.

FIG. 9 illustrates an arrangement in which the holding elements 4 each comprise two holding element parts 4.1 and 4.2, each of which respectively is conveyed by a second conveying organ 31.1 and 31.2 along the supply route at a distance from the other and synchronously with one another. The stack supports 2, which are arranged on a first conveying organ 30, move between the holding element parts 4.1 and 4.2. The stop ledges 8 of each stack support 2 reach underneath the supporting surfaces 7 of the preceding stack support further downstream, as is also depicted in FIG. 1. The distances L.1 and L'.2, (i.e., the holding element parts 4.1 and 4.2), move between the stack supports 2 towards the stack support further downstream, as has also been described in connection with FIG. 4.

In all Figures, only parts of the conveying systems for conveying stack supports 2 and holding elements 4 are illustrated. The complete systems comprise advantageously circulating conveying organs. (i.e., the stack supports 2 are conveyed from the supply stations to a delivery station where the stacks 9 are delivered, and from there back to the beginning of the gathering route.) The holding elements 4 are conveyed from the feed station to a take-over station where they are activated for taking over further articles 5. They are then conveyed back to the feed-in station. The course of the circulation systems is to a great extent freely selectable and can be adapted to the most diverse conditions, which do not have to be directly associated with the gathering operation.

What is claimed is:

1. A method for gathering flat articles (5) in stacks (9) of one or more articles (5) each, the method comprising the steps of:

conveying the stacks (9) being produced one after the other along a gathering route (1) in a stack conveyance direction and past at least one feed station, each stack lying against a supporting surface (7) of a stack support (2), wherein said stack supports (2) are not aligned parallel to the stack conveyance direction;

supplying articles (5) along a supply route (3) in a feed direction to the feed station;

inserting one of the flat articles (5) between each two successive stacks (9) or stack supports (2) respectively, wherein leading edges of the articles (5) are the first portions of the articles (5) to enter between two successive stacks (9) or stack supports (2); and, positioning the inserted article on one of the two successive stacks (9) or supporting surfaces (7) of stack supports respectively, wherein the supply direction comprises a component parallel to the stack conveyance direction, and wherein the articles (5) are inserted between two successive stacks (9) or stack supports (2) while being gripped on their leading edges (5.1).

2. The method according to claim 1, wherein each of the stack supports (2) comprises a stop ledge (8) at a bottom edge of the supporting surfaces (7), the articles (5) are inserted between the stacks (9) or the stack supports (2) from above, the gripped edges (5.1) are directed downwards and the articles (5) are released from being held when the gripped edge (5.1) is positioned immediately above the stop ledge (8).

3. The method in accordance with claim 2, wherein the articles (5) are conveyed towards the feed station with their gripped edges (5.1) directed forwards and are positioned on the upstream stack (9) or on the upstream supporting surface (7), respectively.

4. The method according to claim 2, wherein the articles (5) are conveyed towards the feed station with their gripped edges (5.1) directed backwards and are positioned on the downstream stack (9) or on the downstream supporting surface (7), respectively.

5. The method in accordance with claim 1, wherein, during insertion of the articles between the stacks (9) or stack supports (2), respectively, the gripped edges (5.1) are conveyed more rapidly or more slowly in the stack conveyance direction than the stack supports (2).

6. The method according to claim 5, wherein the supporting surfaces (7) are positioned inclined or slanting relative to the gathering route (1) and wherein, during insertion of the articles between the stacks (9) or stack supports (2), respectively, the gripped edges (5.1) are conveyed in parallel to the supporting surface inclination.

7. The method in accordance with claim 1, wherein the articles (5) are conveyed towards the feed station in a suspended manner and are inserted between the stacks (9) or stack supports (2), respectively, from below, the gripped edges (5.1) being directed upwards.

8. The method according to claim 1, wherein the articles (5) are conveyed towards the feed station with their gripped edge (5.1) oriented towards one side and wherein the articles are inserted sideways between the stacks (9) or stack supports (2), respectively.

9. An arrangement for gathering flat articles (5), the arrangement comprising:

a plurality of stack supports (2), each of the plurality of stack supports (2) comprising a supporting surface (7) and being conveyed one behind the other in a stack conveyance direction along a gathering route (1) past at least one feed station, said supporting surfaces (7) not being aligned parallel to the direction of the gathering route (1)

a plurality of holding elements (4), each of the plurality of holding elements (4) being equipped for held supply of one flat article (5) to the feed station and each of the holding elements (4) being conveyed one after the other in a supply direction along a supply route (3) towards the gathering route (1) and in the feed station, being deactivated for releasing the article (5), wherein the supply direction comprises a component parallel to the stack conveyance direction, wherein the supply route (3) traverses the gathering route (1) at the feed station, wherein conveyance of the stack supports (2) and the holding elements (4) are matched to one another such that, at the feed station, one holding element (4) is conveyed between every pair of successive stack supports (2), and wherein the device further comprises means for deactivating the holding elements (4) during their conveyance between the stack supports.

10. The arrangement according to claim 9, wherein the stack supports (2) are arranged on at least one first conveying organ (30) and the holding elements (4) are arranged on at least one second conveying organ (31), and wherein the conveying organs (30, 31) are arranged in planes parallel to one another at least in the area of the feed station.

11. The arrangement in accordance with claim 9, wherein the supporting surfaces (7) comprise lower and upper edges aligned transverse to the gathering route (1) and lateral edges aligned inclined relative to the gathering route (1), as well as stop ledges (8) located on the lower edge.

12. The arrangement according to claim 11, wherein the supply route (3) traverses the gathering route (1) from above to below and the means for deactivating the holding elements (4) is arranged such that the holding elements (4) are deactivated when positioned in a lower zone of the stack supports (2).

13. The arrangement in accordance with claim 11, wherein the supply route (3) traverses the gathering route (1) from below to above and the means for deactivating the holding elements (4) is arranged such that the holding elements (4) are deactivated when positioned in an upper zone of the stack supports (2).

14. The arrangement according to claim 13, wherein a second stop ledge (8') is provided in the upper zone of each supporting surface.

15. The arrangement in accordance with claim 11, wherein the supply route (3) traverses the gathering route (1) from a first side of the stack supports (2) to a second, opposite side and the means for deactivating the holding elements (4) is arranged such that the holding elements (4) are deactivated when positioned in a zone of the second, opposite side of the stack supports (2).

16. The arrangement according to claim 10, wherein the stack supports (2) are arranged laterally on a first conveying organ (30), the holding elements (4) are arranged laterally on a second conveying organ (31), and the first and second conveying organs (30 and 31) are arranged such that the holding elements (4) and the stack supports (2) pass in combing manner through one another in the traversing area.

17. The arrangement in accordance with claim 16, wherein the stop ledges (8) of the stack supports (2) comprise passages (33) for the holding elements (4).

18. The arrangement according to claim 10, wherein each of the stack supports (2) comprises two stack support parts (2.1, 2.2) arranged at a distanced from one another transverse to the gathering route (1), each of the two stack support parts being arranged on one of two first conveying organs (30.1 and 30.2), and the holding elements (4) and the second conveying organ (31) are arranged to pass in the a traversing zone between the stack support parts (2.1, 2.2).

19. The arrangement in accordance with claim 10, wherein each of the holding elements (4) comprises two holding element parts (4.1 and 4.2) distanced from each other transverse to the gathering route (1), each holding element part being arranged on one of two second conveying organs (31.1 and 31.2), and the stack supports (2) and the first conveying organ (30) are arranged between the holding element parts (4.1 and 4.2).

20. The arrangement according to claim 9, wherein the stack supports (2) are V-shaped compartments (20) arranged transverse to the gathering route (1) and comprising side walls arranged one behind the other in the stack conveyance direction and a floor joining the side walls, wherein one of the side walls serves as supporting surface (7) and the floor as stop ledge (8), and wherein the other side wall (21) is capable of taking over the function of the next upstream or downstream stack support (2).

* * * * *

UNITED STATES PATENT AND TRADEMARK OFFICE

CERTIFICATE OF CORRECTION

PATENT NO. : 6,749,190 B2
DATED : June 15, 2004
INVENTOR(S) : Studer

It is certified that error appears in the above-identified patent and that said Letters Patent is hereby corrected as shown below:

Column 12,
Line 16, after "in" delete "the".

Signed and Sealed this

Fourth Day of January, 2005

JON W. DUDAS
*Director of the United States Patent and Trademark Office*